United States Patent [19]

Tuck

[11] 4,345,856

[45] Aug. 24, 1982

[54] COMPOSITION AND PROCESS FOR STABILIZING EMBANKMENTS

[76] Inventor: Philip C. Tuck, 192 Spring St., West Bridgewater, Mass. 02379

[21] Appl. No.: 97,690

[22] Filed: Nov. 28, 1979

[51] Int. Cl.[3] ..... E02B 3/04; E02D 17/20

[52] U.S. Cl. ..... 405/258; 405/15

[58] Field of Search ..... 405/128, 129, 258, 270, 405/15, 16; 404/76

[56] References Cited

U.S. PATENT DOCUMENTS

| | | | |
|---|---|---|---|
| 984,801 | 2/1911 | Davis | 404/81 |
| 1,608,258 | 11/1926 | Tappan | 405/258 |
| 1,809,636 | 6/1931 | Miller | 405/107 |
| 1,935,090 | 11/1933 | Holland | 405/129 |
| 2,017,417 | 10/1935 | McCarthy | 405/129 |
| 2,315,351 | 3/1943 | Schaefer | 405/258 |
| 2,481,497 | 9/1949 | Buzell et al. | 405/16 |
| 2,745,768 | 5/1956 | Karch | 405/15 X |
| 3,614,867 | 10/1971 | Nieman | 405/129 |
| 3,718,003 | 2/1973 | Cook et al. | 405/129 |
| 4,028,130 | 6/1977 | Webster et al. | 405/129 X |
| 4,030,307 | 6/1977 | Avedisian | 405/270 |
| 4,194,855 | 3/1980 | Egger | 405/258 X |

OTHER PUBLICATIONS

Hewes, *American Highway Practice,* vol. I, 1942, pp. 144–147, 157, 171–177, 202, 203, 211–219.

Krynine, "Stability of Cuts and Embankments", *Soil Mechanics Its Principles and Structural Applications,* Second Edition, 1947, pp. 235, 276–277, 280–283.

*Primary Examiner*—James A. Leppink

*Assistant Examiner*—George A. Suchfield

*Attorney, Agent, or Firm*—Thompson, Birch, Gauthier & Samuels

[57] ABSTRACT

The invention relates to a composition and process for grading and immediate stabilization of embankments, for example, in road, levee or canal construction. Use of a mixture of rip rap and loam permits the construction of a steeper embankment than has previously been possible with inexpensive materials and unskilled labor thereby conserving valuable space along the embankment. It also provides for immediate stabilization eliminating erosion during construction. The loam and rip rap may be premixed or, alternatively, the loam may be interjected into preplaced rip rap, for example, in a water slurry. Additional stabilization is provided due to the fact that an embankment made according to this invention will support vegetation and other plant life and ultimately result in an indestructible, interwoven stabilization medium. The planting of vegetation can be varied to suit the climate involved or the particular purpose intended, i.e., wildlife cover and food. Ultimately this process of stabilization will provide a more aesthetic end result.

20 Claims, 9 Drawing Figures

COMPOSITION AND PROCESS FOR STABILIZING EMBANKMENTS

BACKGROUND OF THE INVENTION

It is well-known in the art to construct embankments from a variety of materials in connection with road construction and the like. On the one hand, it is desirable to construct such embankments with as steep a grade as possible to conserve space along the embankment. For example, in constructing a road many miles in length, the cost of acquiring a right-of-way even a few additional inches in width can be considerable. There are also important environmental and aesthetic factors which dictate minimizing the total width of the roadway and embankment. The method of this invention will conserve space when building roads through or along swamps or wetland areas, thus preserving valuable flood storage capacity and limiting desecration of these valuable areas.

On the other hand, the cost of acquiring a wider right-of-way and related factors must be balanced against the monetary and aesthetic costs of the alternative construction methods. Thus, for example, an elevated roadway could be constructed entirely on steel pilings and supports and thereby achieve essentially a 90° embankment which uses the minimum amount of lateral space. Similarly, a depressed or below ground-level roadway could be constructed in a concrete culver and, again, achieve essentially a 90° embankment. Not only are such constructions usually considered to be an eyesore, but they are also so expensive that their use is generally restricted to densely-populated urban areas where land values are sufficiently high to justify such uneconomical construction methods.

In the typical case, however, a trade-off must be made between the steepness of the embankment and the cost of construction. Where land is relatively inexpensive and plentiful, embankments may be constructed almost entirely from earth. Although such embankments gradually become stabilized by the growth of vegetation, initially such embankments cannot exceed a gradient of about 10° without danger of erosion. Alternatively, embankments may be constructed from stones ranging in size from relatively small gravel-sized stones to large boulders. Although this type of material permits the construction of stable embankments having gradients of about 20°, this type of construction is also more expensive and produces a somewhat barren-looking landscape because the stone embankments cannot support vegetation.

DESCRIPTION OF THE PRIOR ART

U.S. Pat. No. 3,938,279 describes a growth medium used for covering the surface of the ground which consists of a mixture of inorganic mineral binder based on cement, an organic fibrous material and fertilizer. This invention is intended for use on level as well as graded land, including use on road embankments and the like. This patent is not directed, however, to the construction and stabilization of such embankments but only to a process for vegetating land which is subject to erosion. Although the ultimate result of this invention would be to stabilize an earthen embankment (see Example 5), there is no immediate stabilization effect, nor would this invention operate on an embankment consisting exclusively of gravel and stone where there would be no soil to support vegetation.

U.S. Pat. No. 1,171,560 describes a method for improving the drainage of level ground which consists of laying a bed of stones below twelve inches or more of earth in connection with growing grass for golf putting greens. No stabilization is provided by this invention nor is any intended because the invention is limited to drainage of level surfaces. Any mixture of soil and stones in this invention would be undesirable because it would reduce the drainage capacity of the stone bed.

U.S. Pat. Nos. 2,925,831; 3,687,021; and 4,073,753 relate to compositions and methods for paving which involve intermixing aggregates with finer materials. None of these patents, however, suggest the construction of stable embankments using the materials and methods which are herein described.

OBJECTS OF THE INVENTION

Accordingly, it is a primary object of this invention to provide a new and improved composition and process for grading and stabilizing embankments.

It is another object of this invention to provide a grading and stabilization composition comprising inexpensive and readily-available materials.

It is a further object of this invention to provide a grading and stabilization composition which permits the safe and stable construction of steeper embankments than has heretofore been possible with materials of comparable cost and availability.

Another object of this invention is to provide a new and improved process for grading and stabilizing embankments using the grading and stabilization composition of this invention.

Still another object of this invention is to provide a new and improved composition and process for grading and stabilizing embankments which includes planting grass, trees and other vegetation for additional stability and aesthetic reasons.

The realization of these and other objectives will become apparent from the following description.

DETAILED DESCRIPTION OF THE INVENTION

Figure 1A:
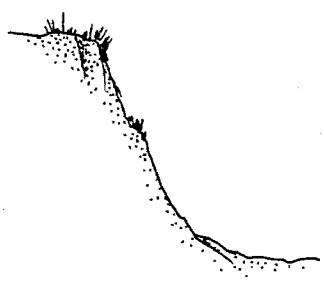
FIG. 1 is a schematic illustration of the various steps involved in grading an existing embankment according to one embodiment of this invention.
Figure 1B:
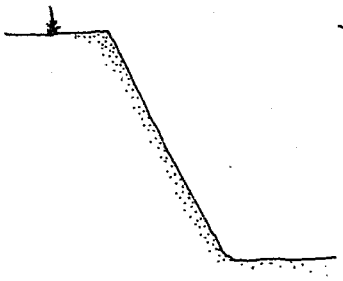
Figure 1C:
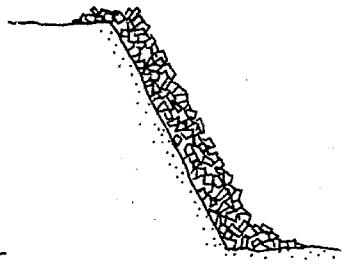
Figure 1D:
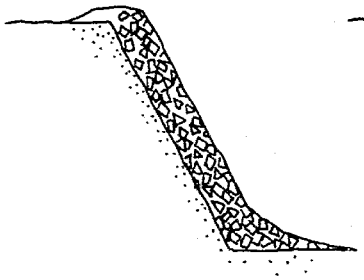
Figure 1E:
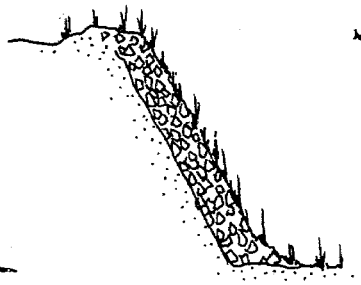
Figure 1F:
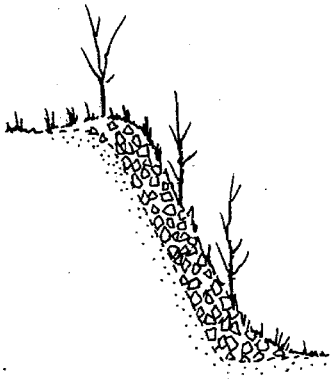

FIG. 1(*a*) shows an exposed and pre-existing embankment which is to be graded and stabilized in accordance with this invention. This slope is typically rough and irregular consisting of loose earth, rock and perhaps some sparse vegatation. In this form, the slope is readily subject to erosion.

The first step in stabilizing such an embankment is to uniformly grade the exposed slope to approximately the final desired incline, as shown in FIG. 1(*b*). In cases where the exposed slope is already of approximately the final desired gradient, this preliminary step may be omitted.

The second step according to this invention is to cover the graded slope with rip rap to a depth of about 2–4 feet as measured perpendicular to said slope as shown in FIG. 1(*c*). Establishing the optimum depth of the rip rap is a routine matter for one of ordinary skill in the art. In general, however, the depth will vary according to the desired steepness of the slope. A maximum stable steepness of about 50°–70° from the horizontal can be attained using about a two-four foot depth of rip rap. Less steep slopes can be stabilized according to this invention using less rip rap.

As used in this application, the term "rip rap" refers to a mixed aggregate of processed stone ranging in size from about 6–18 inches in diameter. In the preferred embodiment of this invention, the stone consists primarily of granite. Also, in the preferred embodiment, at least about 25% of said rip rap is less than 10 inches in diameter and at least about 25% is greater than 10 inches in diameter. This composition can be varied if desired. To a limited extent, natural stone of approximately the same dimensions may be substituted in whole or in part for the processed stone. However, because natural stone tends to be smooth and rounded and lacking the sharp edges of processed stone and resulting in interlocking properties, in general it is less effective for the purposes of this invention. Concrete rubble or other hard aggregate can also be substituted with varying results.

The rip rap may be applied to the slope in any conventional manner, for example, by means of bulldozers or dump trucks, and is then graded by conventional means to approximately a uniform depth along the slope as shown in FIG. 1(*c*). In the preferred embodiment of this invention, the graded rip rap is about 25% deeper along the bottom of the slope than along the top. Also, an amount of rip rap is applied to the top of the embankment to a depth of about 50% the depth of the rip rap along the top of the slope.

In one embodiment of this invention, loam can be premixed with rip rap before the rip rap is applied to the slope. There are numerous difficulties with this approach, however, including the problem of maintaining a relatively even distribution of loam among the rip rap during the application process. In another embodiment, the loam is added after the rip rap is already in place and graded. This may be done, for example, by simply covering the surface of the graded rip rap and permitting the loam to gradually work its way into the interstices of the rip rap by the natural action of wind, rain and gravity. This method, however, is inefficient and may require some time for completion. In addition, because some of the loam applied in this manner will be eroded, one or more subsequent applications of loam may be required. In still another embodiment, the loam can be placed on the surface of the rip rap and forced into the interstices of the rip rap by means of a high pressure air or water hose. However, this procedure involves two separate steps, is not very efficient, and tends to be cumbersome.

This problem is alleviated by the preferred embodiment of this invention in which loam is "hydrojected" into preplaced rip rap as shown in FIG. 1(*d*). The "hydrojection" process of this invention is not a mere spraying application of a water-slurry of loam to the surface of the graded rip rap. Instead, this process involves actually interjecting a water-slurry of loam into the interstices of the rip rap. It has been found that this process can effectively and efficiently distribute loam throughout a bed of prelaid rip rap. Conventional apparatus for applying slurry compositions can be employed as is or with relatively minor modifications for this purpose.

If desired, the slurry can be hydrojected in two separate layers, with grass seed and fertilizer mixed into the slurry and applied as a thin second layer, thereby eliminating the necessity of hand seeding or hydroseeding as a subsequent step. If a perfectly smooth surface is desired, the loam may be brought to the top surface of the rip rap and then sodded. A further variation in this invention consists of leaving slight depressions among the stones and then seeding or planting. This procedure allows for some entrapment of water and percolation into the ground while slowing the velocity of the runoff as a storm water management feature.

As used in this application, the term "loam" is meant to include any type of soil or soil-like material, such as top soil, whether of natural or synthetic origin, comprised of relatively small particles on the order of 1/16 inch or less in size. In the preferred embodiment of this invention, however, the loam consists at least predominantly of soil having a total sand and clay content of not more than about 50% by weight. The remainder would be of organic content. The advantages of using natural earth include the fact that it is inexpensive, readily-available, supports vegetation, and has a remarkably high degree of cohesiveness. Loam with too high a clay content will not readily support vegetation. Loam with too high a sand content will neither readily support vegetation nor have the most desirable degree of cohesiveness.

The amount of loam used for a given volume of rip rap depends on the relative steepness of the slope and the size distribution of the stone comprising the rip rap. The latter factor determines the volume of the interstices among the rip rap. How completely these interstices are filled with loam determines, in part, the stability of the resulting slope. In general, it is preferred to use one part loam by volume for every 2–10 parts by volume of rip rap, but these proportions may be varied by routine experimentation to suit particular needs.

Once the slope has been graded and stabilized with rip rap and loam as described above, it may be planted immediately with seed, grass plugs, tree seedlings, or other vegetation as shown in FIGS. 1(*e*) and 1(*f*). Over time, the growth of such vegetation will provide additional stabilization and protection against erosion as well as beautifying the embankment and providing oxygen and food and cover for wildlife.

Figure 2A:
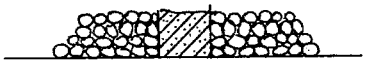
FIG. 2 is a schematic illustration of the various steps involved in constructing, grading and stabilizing an embankment and road according to another embodiment of this invention.
Figure 2B:
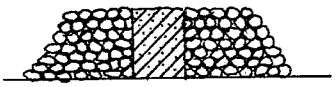
Figure 2C:
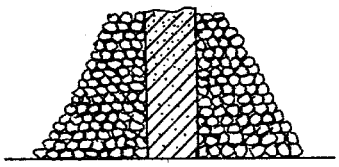

FIG. 2 shows how a variation of this invention can be used to construct and stabilize an embankment where there is no existing embankment or else where the existing embankment is not high enough for the desired purposes. In the first step of this embodiment of the invention, as shown in FIG. 2(*a*), a first pair of rip rap embankments is constructed on either side of the center area which is to be filled. In general, this first pair of rip rap embankments may range in height from about 4–10 feet depending on the stability of the rip rap piles. In the second step, this first pair of rip rap embankments and the cavity therebetween is filled with gravel or fill. This may be accomplished by any conventional means such as with bulldozers or dumptrucks. The gravel or fill can simply be poured into the cavity. The pair of rip rap embankments is then filled with loam according to this invention.

Once this first layer has thus been filled and stabilized, a second tier of rip rap embankments may be constructed and thereafter filled in the same manner as the first layer as shown in FIG. 2(*b*). This process may be repeated several times until the embankment finally reaches the desired height as shown in FIG. 2(*c*).

Other variations and uses for this invention will be readily apparent to those skilled in the art. This invention has numerous important advantages over the prior art. First, this invention permits the safe construction of steeper embankments than has heretofore been possible with materials of like cost and availability and is relatively quickly constructed. The rip rap and loam combination of this invention safely stabilizes a steeper slope than is possible with either rip rap or loam by itself. This invention is also cost effective in that all of the grading and construction work related to this process can be performed by unskilled labor. The result of this invention is immediate stabilization of a relatively steep slope. There is no need to wait for vegetation to take root and develop as is required, for example, before stabilization is achieved with the Fonne invention (U.S. Pat. No. 3,938,279). At the same time, in contrast to the use of stone or gravel materials solely, the grading composition of this invention will immediately support vegetation which will gradually provide even greater stability and aesthetic appeal.

The composition and process for stabilizing embankments, as described herein, may be applied to, but is not limited to, any of the following: the embankments of roadways, canals, rivers, streams and other waterways; ponds, lakes, levees and railroad beds; the regrading of embankments for purposes of reclamation of sand and gravel pits; and the reclamation of areas which have been strip-mined.

Having described the invention, what is claimed is:

1. A composition for grading and stabilizing embankments by application to the surface of an embankment in depths of about 2–4 feet, as measured perpendicular to the embankment, in the absence of any artificial supporting means, which composition consists essentially of a mixture of rip rap and loam wherein said rip rap consists essentially of a mixed aggregate of processed stone ranging in size from about 6–18 inches in diameter in which at least about 25% of said rip rap is less than 10 inches in diameter and at least about 25% is greater than 10 inches in diameter, and the proportion by volume of loam to rip rap is from about 1–10 to 1–2.

2. The composition of claim 1 wherein said rip rap consists predominantly of granite stone.

3. The composition of claim 1 wherein said loam has a total sand and clay content of not more than about 50% by weight.

4. A method for grading and stabilizing an embankment comprising applying to the surface of said embankment in depths of about 2–4 feet, as measured perpendicular to the embankment, in the absence of any artificial supporting means a mixture consisting essentially of rip rap and loam wherein said rip rap consists essentially of a mixed aggregate of processed stone ranging in size from about 6–18 inches in diameter in which at least about 25% of said rip rap is less than 10 inches in diameter and at least about 25% is greater than 10 inches in diameter, and the porportion by volume of loam to rip rap is from about 1–10 to 1–2.

5. The method of claim 4 wherein said rip rap consists predominantly of granite stones.

6. The method of claim 4 wherein said loam has a total sand and clay content of not more than about 50% by weight.

7. The method of claim 4 wherein said rip rap and loam are premixed before being applied to said embankment.

8. The method of claim 4 wherein said rip rap is first applied to said embankment and thereafter said loam is added.

9. The method of claim 8 wherein said loam is applied to the surface of said rip rap.

10. The method of claim 8 wherein said loam is interjected into said rip rap in the form of a water slurry.

11. The method of claim 4 wherein said embankment is additionally stabilized and beautified by planting vegetation.

12. A method for grading and stabilizing a pre-existing embankment comprising the following steps:

(a) grading an exposed slope to the desired gradient;

(b) applying to the surface of said embankment in depths of about 2–4 feet as measured perpendicular to said slope in the absence of any artificial supporting means a mixture consisting essentially of rip rap and loam wherein said rip rap consists essentially of a mixed aggregate of processed stone ranging in size from about 6–18 inches in diameter in which at least about 25% of said rip rap is less than 10 inches in diameter and at least about 25% is greater than 10 inches in diameter, and the proportion by volume of loam to rip rap is from about 1–10 to 1–2; and;

(c) planting said slope with vegetation comprising grass and trees.

13. The method of claim 12 wherein said rip rap and loam are pre-mixed before being applied to said slope.

14. The method of claim 12 wherein said rip rap is first applied to said slope and thereafter said loam is added.

15. The method of claim 14 wherein said loam is applied to the surface of said rip rap.

16. The method of claim 14 wherein said loam is interjected into said rip rap in the form of a water slurry.

17. The method of claim 12 wherein said mixture of rip rap and loam is applied along said slope such that the perpendicular depth of said mixture along the bottom of said slope is about 25% greater than the depth along the top of said slope.

18. The method of claim 17 wherein said mixture of rip rap and loam is also applied at the top of said slope to a depth of about 50% that along said slope.

19. A method for constructing and stabilizing an embankment comprising the following steps:

(a) constructing a first pair of rip rap embankments on either side of a space to be filled stabilized;

(b) filling said first pair of rip rap embankments with loam and the cavity therebetween with gravel or fill;

(c) constructing a second layer of rip rap embankments on top of said first pair of embankments followed again by filling said embankments with loam and the cavity therebetween with gravel or fill; and, (d) constructing successive layers in a similar manner until said embankment attains the desired height.

20. The method of claim 19 wherein said embankment is planted with vegetation comprising grass and trees.

* * * * *